US012584183B2

(12) United States Patent
Murakami et al.

(10) Patent No.: US 12,584,183 B2
(45) Date of Patent: Mar. 24, 2026

(54) MOLTEN IRON DEPHOSPHORIZATION METHOD

(71) Applicant: JFE STEEL CORPORATION, Tokyo (JP)

(72) Inventors: Yumi Murakami, Tokyo (JP); Nobuhiko Oda, Tokyo (JP); Hidemitsu Negishi, Tokyo (JP); Ryo Kawabata, Tokyo (JP); Naoki Kikuchi, Tokyo (JP); Yusuke Fujii, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 598 days.

(21) Appl. No.: 17/626,083

(22) PCT Filed: Jul. 2, 2020

(86) PCT No.: PCT/JP2020/025979

§ 371 (c)(1),
(2) Date: Jan. 10, 2022

(87) PCT Pub. No.: WO2021/014918

PCT Pub. Date: Jan. 28, 2021

(65) Prior Publication Data

US 2022/0259686 A1 Aug. 18, 2022

(30) Foreign Application Priority Data

Jul. 22, 2019 (JP) ..... 2019-134742

(51) Int. Cl.
*C21C 1/02* (2006.01)

(52) U.S. Cl.
CPC ..... *C21C 1/02* (2013.01)

(58) Field of Classification Search
CPC ..... C21C 1/02; C21C 5/4673; C21C 5/35; C21C 5/4606; C21C 7/064; C21C 5/30
See application file for complete search history.

(56) References Cited

U.S. PATENT DOCUMENTS 6,017,380 A 1/2000 Kitamura et al.
2011/0127701 A1* 6/2011 Grant ..... C21C 5/5217 266/268
2020/0392592 A1 12/2020 Oda et al.

FOREIGN PATENT DOCUMENTS

CN 101921889 A 12/2010
JP H08-325621 A 12/1996
(Continued)

OTHER PUBLICATIONS

Aug. 2, 2022 extended Search Report issued in European Patent Application No. 20843908.3.
(Continued)

*Primary Examiner* — Anthony M Liang
(74) *Attorney, Agent, or Firm* — Oliff PLC

(57) ABSTRACT

A dephosphorization method using a top and bottom blown converter. This method uses a converter charged with molten iron and slag, to blow an oxygen-containing gas from a top-blowing lance, supply the gas from an inlet of a blowing hole, and supply a control gas from an opening toward an axial center. This method has: a slag top-surface position measurement step, with the top surface of the molten iron measured in advance, measuring an arbitrary position in a top surface of the slag; a slag top-surface difference calculation of slag thickness difference between the measured top-surface positions of the molten iron and the slag; and a jetting condition adjustment step of, using the obtained slag thickness, adjusting a jetting condition of the gas jetted from the top-blowing lance into an appropriate range. The top-blown jetting condition is adjusted by comparing the slag thickness and the depth of a surface depression.

6 Claims, 2 Drawing Sheets

(56) References Cited

FOREIGN PATENT DOCUMENTS

| | | | |
|---|---|---|---|
| JP | 2002-322507 | A | 11/2002 |
| JP | 2003-113412 | A | 4/2003 |
| JP | 2005-139529 | A | 6/2005 |
| JP | 2006-188769 | A | 7/2006 |
| JP | 2007-297694 | A | 11/2007 |
| JP | 4616790 | B2 * | 1/2011 |
| JP | 2015-101734 | A | 6/2015 |
| JP | 2017-52976 | A | 3/2017 |
| JP | 2017-101294 | A | 6/2017 |
| TW | 201829788 | A | 8/2018 |
| WO | 2019/123873 | A1 | 6/2019 |

OTHER PUBLICATIONS

Aug. 3, 2022 Office Action issued in Chinese Patent Application No. 202080050175.7.
Dec. 22, 2022 Office Action issued in Korean Patent Application No. 10-2021-7040429.
Sep. 15, 2020 International Search Report issued in International Patent Application No. PCT/JP2020/025979.
Feb. 8, 2021 Office Action issued in Taiwanese Patent Application No. 109123335.

* cited by examiner

MOLTEN IRON DEPHOSPHORIZATION METHOD

TECHNICAL FIELD

The present invention relates to a method of dephosphorization of molten iron by using a top and bottom blown converter charged with molten iron and slag and blowing an oxygen-containing gas from a top-blowing lance.

BACKGROUND ART

From the viewpoint of increasing the efficiency of each oxidation reaction in oxidation refining of molten iron, it is important to develop a nozzle that allows a jet flow velocity and a gas flow rate at a bath surface of an oxygen-containing gas jetted out from a top-blowing lance to be controlled at the same time according to the height of slag. Meanwhile, it is common practice in converter refining operation to reduce the blending ratio of molten pig iron and introduce an iron source, such as scrap, from the viewpoint of preventing global warming through energy conservation and $CO_2$ reduction. Agitating by a bottom-blown gas is additionally used to accelerate carburization of scrap etc. and promoting melting thereof.

One example can be found in dephosphorization refining of molten pig iron in a converter. It is known that a dephosphorization reaction progresses in accordance with Reaction Formula (1) shown below at a slag-metal interface:

$$2[P]+2(FeO)+3(CaO\cdot FeO) \quad (I)$$

$$\rightarrow(3CaO\cdot P_2O_5)(s)+5[Fe] \quad (1)$$

Here, [M] represents an element M in the molten pig iron, and (S) represents a chemical substance S in the slag.

As can be seen from Reaction Formula (1), the dephosphorization reaction is an oxidation reaction, for which the presence of iron oxide (FeO) is essential. Since the resulting phosphorus oxide ($P_2O_5$) is unstable, it needs to be reacted with lime (CaO) to form $3CaO\cdot P_2O_5$ and stabilized in the slag. Therefore, lime is also essential for dephosphorization refining. FeO in the slag is generated as the oxygen-containing gas jetted out from the top-blowing lance is absorbed by molten iron at a hot spot and oxidizes the iron. At the time of feeding, lime that reacts with phosphorus oxide has a melting point of not lower than 2500° C., which is much higher than the furnace internal temperature of 1300 to 1500° C., making the reaction efficiency significantly low. However, the lime turns into slag by reacting with iron oxide to form calcium ferrite (CaO·FeO) with a low melting point, thereby contributing to the dephosphorization reaction. Thus, it can be seen that iron oxide does not only directly oxidize P but also contributes to increasing the efficiency of the dephosphorization reaction by turning lime into slag. At an initial stage where the P concentration in the molten iron is high, the rate of the dephosphorization reaction is determined by the supply of oxygen or calcium ferrite. On the other hand, at a terminal stage where the P concentration has become low, it is determined by the supply of P to the slag-metal interface, and therefore agitating by a bottom-blown gas is additionally used to lower the P concentration reached at the end of the process.

In this connection, a method has been reported in which a top-blown oxygen jet flow is controlled so as to be blocked by slag from directly coming into contact with molten pig iron, so that oxygen activity at a slag-metal interface is enhanced and the formation of iron oxide (FeO) is promoted to dramatically increase the dephosphorization efficiency. For example. Patent Literature 1 proposes a method in which the flow rate of top-blown oxygen, the height of a top-blowing lance, the hole diameter and the number of nozzles of the lance, and an amount of flux to be added are adjusted such that a top-blown oxygen jet flow is blocked by slag from directly coming into contact with molten iron.

Patent Literature 2, which takes notice of a phenomenon that a dust concentration is low when top-blown oxygen is not in contact with molten pig iron and that the dust concentration increases extremely when the top-blown oxygen comes into contact with the molten pig iron, proposes a method for reliably performing non-contact blowing by determining whether top-blown oxygen and molten pig iron are in contact with each other using a dust concentration meter installed in an exhaust gas duct, and adjusting the flow rate of the top-blown oxygen and/or the height of a top-blowing lance.

CITATION LIST

Patent Literature

Patent Literature 1: Japanese Patent Laid-Open No. 2002-322507

Patent Literature 2: Japanese Patent Laid-Open No. 2003-113412

SUMMARY OF INVENTION

Technical Problem

However, the above-described conventional technologies have the following problems.

In converter dephosphorization, top and bottom blown converters incorporating agitating of molten iron by a bottom-blown gas as described above are widely used. However, the blowing methods described in Patent Literature 1 and Patent Literature 2 do not mention bottom-blowing conditions, and these are technologies that take into account application to only blowing in top-blown converters. Therefore, if applied to top and bottom blown converters as they are, these technologies would create obstacles to operation. For example, it is commonly known that slag in a top and bottom blown converter contains granular iron caused by a bottom-blown gas. When blowing is performed so as to prevent a top-blown jet flow from penetrating through the slag containing such granular iron, oxygen dispersed in the slag may fail to reach the bath surface of the molten iron by being absorbed by the suspended granular iron. Further, as a result of the granular iron absorbing the oxygen, the granular iron in the slag takes a longer time to sink down with respect to a blowing time. Thus, iron oxide (FeO), even when formed, contributes less at the slag-metal interface, which may significantly slow the progress of the dephosphorization reaction.

Further, an excessive accumulation in the slag of iron oxide (FeO) that does not contribute to the reaction may lead to a major obstacle to operation, as it promotes bubbling of the slag and causes a phenomenon called slopping, in which, during blowing, the slag swells up by bubbling abnormally and scatters through a furnace opening. Thus, when applied to top and bottom blown converters, the dephosphorization blowing methods described in Patent Literature 1 and Patent Literature 2 do not only significantly impede the progress of the dephosphorization reaction but may make the operation itself impossible due to slopping.

To solve these problems, an environment where an oxygen jet flow for blowing is penetrating through the slag should be maintained. To this end, the conventional lance technology as used in Patent Literature 2 cannot provide any measures during blowing other than reducing the height of the lance while the oxygen jet flow is not penetrating through the slag. However, from the viewpoint of the reaction interface area, securing a large area (hot spot area) in which the jet flow impinges on the bath surface of the molten iron is effective in efficiently supplying iron oxide (FeO) that contributes to the dephosphorization reaction to the slag-metal interface. Reducing the height of the lance leads directly to a reduced hot spot area and consequently to lower efficiency of the dephosphorization reaction, and is therefore not desirable.

The present invention aims to solve the above problems and propose a molten iron dephosphorization method that is applied to dephosphorization blowing using a top and bottom blown converter, and that stably supplies iron oxide (FeO) contributing to a dephosphorization reaction to a slag-metal interface and also prevents slopping, which is an obstructing factor for operation.

Solution to Problem

Firstly, a molten iron dephosphorization method of the present invention that advantageously solves the above-described problems is a molten iron dephosphorization method that uses a top and bottom blown converter charged with molten iron and slag, and that, to perform dephosphorization of the molten iron by blowing an oxygen-containing gas from a top-blowing lance, supplies the oxygen-containing gas as a main gas from an inlet of one or more blowing main holes that are disposed so as to penetrate through an outer shell of the top-blowing lance, and supplies a control gas from an opening disposed in an inner wall surface of the blowing main hole toward an axial center of the blowing main hole through a control gas supply passage.

The molten iron dephosphorization method is characterized in that the method has:

a slag top-surface position measurement step of, with the position of a top surface of the molten iron having been measured in advance, continuously or intermittently measuring an arbitrary position in a top surface of the slag present on the molten iron;

a slag top-surface deviation calculation step of calculating a slag thickness that is a difference between the measured top-surface positions of the molten iron and the slag; and a jetting condition adjustment step of, using the obtained slag thickness, adjusting a jetting condition of the oxygen-containing gas jetted from the top-blowing lance into an appropriate range.

Secondly, a molten iron dephosphorization method of the present invention that advantageously solves the above-described problems is a molten iron dephosphorization method that uses a top and bottom blown converter charged with molten iron and slag, and that, to perform dephosphorization of the molten iron by blowing an oxygen-containing gas from a top-blowing lance, supplies the oxygen-containing gas as a main gas from an inlet of one or more blowing main holes that are disposed so as to extend through an outer shell of the top-blowing lance, and supplies a control gas from an opening disposed in an inner wall surface of the blowing main hole toward an axial center of the blowing main hole through a control gas supply passage.

The molten iron dephosphorization method is characterized in that the method has:

an initial slag thickness calculation step of, with the position of a top surface of the molten iron and the position of a top surface of the slag having been measured in advance, calculating a slag thickness;

a slag thickness change calculation step of continuously measuring the position of the top surface of the slag during blowing and calculating changes in the slag thickness; and a jetting condition adjustment step of, using the obtained initial slag thickness and changes in the slag thickness, adjusting a jetting condition of the oxygen-containing gas jetted from the top-blowing lance into an appropriate range.

The molten metal dephosphorization methods according to the present invention can be more preferable solutions when:

a. The oxygen-containing gas jetted from the top-blowing lance penetrates through the slag on the molten iron and reaches the top surface of the molten iron;

b. The depth of a depression in the molten iron made by the oxygen-containing gas having penetrated through the slag is less than 10% of the thickness of the slag;

c. The adjustment of the jetting condition of the top-blowing lance is the adjustment of a ratio between a control gas supply pressure and a main gas supply pressure; and d. The adjustment of the jetting condition of the top-blowing lance is the adjustment of a ratio between a control gas flow rate and a main gas flow rate.

Advantageous Effects of Invention

According to the present invention, in dephosphorization of molten iron using a top and bottom blown converter, blowing is performed while appropriate conditions of jetting an oxygen-containing gas from a top-blowing lance are maintained, particularly an environment where the top-blown oxygen jet flow is in contact with the molten iron is maintained. This makes it possible to stably supply iron oxide (FeO) to the slag-metal interface, as well as to prevent slopping by precluding excessive accumulation in the slag of iron oxide (FeO) that does not contribute to the reaction.

DESCRIPTION OF EMBODIMENTS

Figure 1:
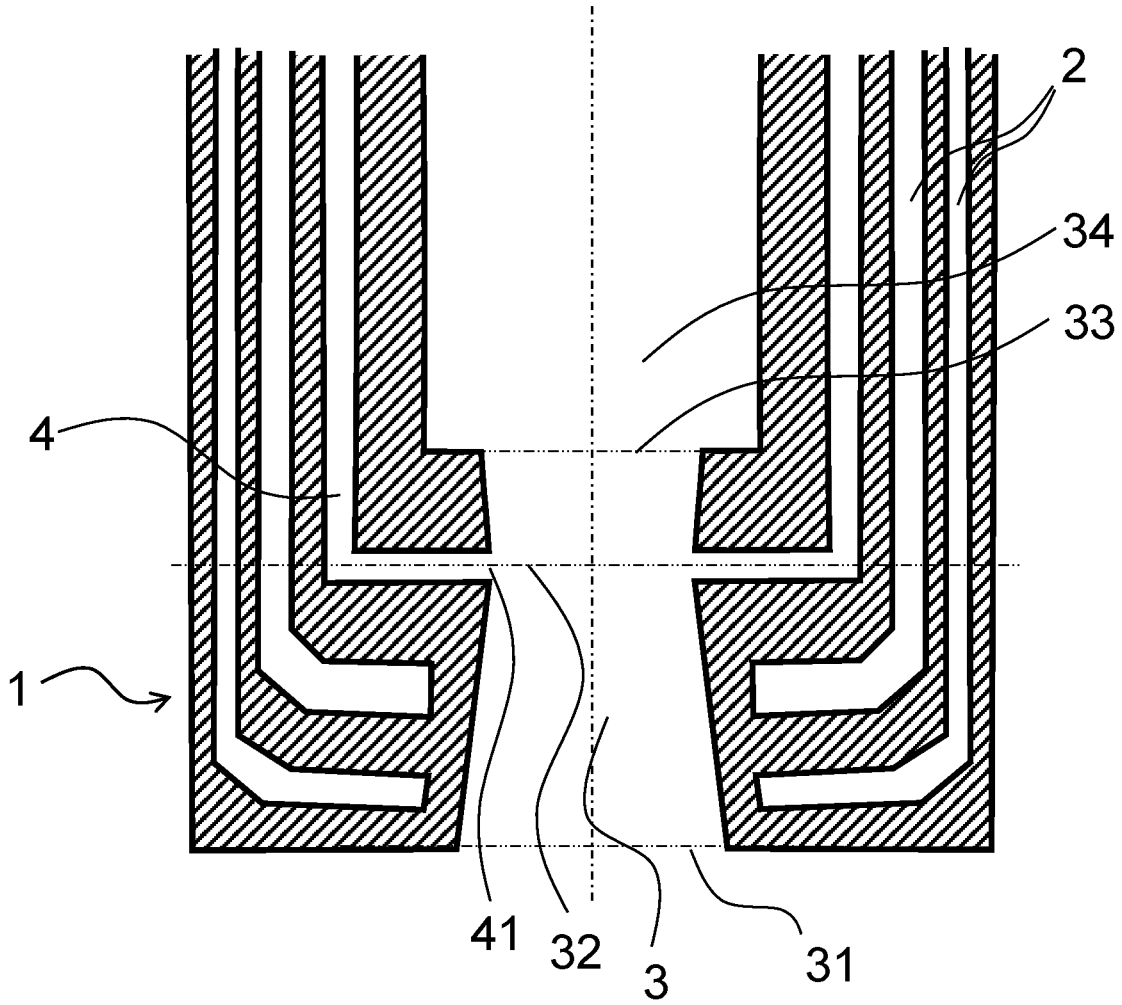
FIG. 1 is a sectional view of a leading end of a top-blowing lance that is used in a molten iron dephosphorization method according to one embodiment of the present invention.

A molten iron dephosphorization method of the present invention will be described in detail below based on a preferred example shown in the drawings.

FIG. 1 is a schematic view showing a vertical section of a leading end of a top-blowing lance 1 for a converter that is suitably used for the molten iron dephosphorization method according to one embodiment of the present invention. In FIG. 1, a lower end part of the top-blowing lance 1 is shown. The top-blowing lance 1 includes one or more blowing main holes 3 through which an oxygen-containing gas inside a gas tank 34 is jetted toward a bath surface inside a reaction vessel, and includes control gas supply passage 4 having an opening 41 that is disposed in an inner wall surface of each blowing main hole 3 to jet out a control gas into the blowing main hole 3. The opening 41 is configured so as to jet out the control gas toward an axial center of the blowing main hole 3. The top-blowing lance 1 has cooling water circulation passages 2. In the example of FIG. 1, the blowing main hole 3 has a shape of an hourglass drum formed by combining two truncated cones. The opening 41 is formed in an inner wall surface of a throat part 32 of the blowing main hole 3 at which the cross-sectional area is smallest. The shape of this blowing main hole 3 is that of a so-called Laval nozzle. As the oxygen-containing gas supplied to the blowing main hole 3, for example, an oxygen gas can be used, and the control gas may be the same gas as the oxygen-containing gas or may be an inert gas, such as a nitrogen gas.

In the top-blowing lance used in the present invention, inside a nozzle (blowing main hole 3) of the top-blowing lance as shown in FIG. 1, the control gas is brought into collision with a main flow from a direction different from an advancing direction of the main flow, whereby the flow path of the main flow is changed and the flow velocity thereof is controlled. The original flow path along which the main flow flows is the entire cross-section of the nozzle. When the control gas is introduced, the main flow flows so as to avoid the control gas flow, and thus the flow passage cross-sectional area of the main flow is restricted.

This principle employs a fluid device that is one of the devices using fluid phenomena. A fluid device is a general term for devices that use functions provided by an effect of interference between a jet flow and a side wall, an effect of a collision between two jet flows, a fluid phenomenon caused by a vortex, and fluctuations in flow velocity of a jet flow itself, and is studied in the field of fluid dynamics. For example, a fluid device takes a form in which a supply port of a control fluid is disposed near an outlet of a flow passage of a jet flow, in a direction at a right angle to the jet flow. When a fluid is introduced to the jet flow through the supply port of the control fluid, the jet flow is contracted by the control fluid, so that the cross-sectional area of the jet flow is reduced at a part, and even in the case of the flow passage having a straight shape (being a straight nozzle), the jet flow behaves as if it were a Laval nozzle. Thus, the gas jetted from the blowing main hole 3 (a mixture gas of the main oxygen-containing gas and the control gas) has a higher flow velocity at an outlet 31 of the blowing main hole 3. Fluid devices have an advantage in that they need not a mechanical movable part. In the case where a Laval nozzle is formed by providing the throat part 32 in the blowing main hole as shown in FIG. 1, it is preferable that the opening 41 be disposed in the vicinity of the throat part 32. Further, in the case where the blowing main hole 3 is formed as a cylindrical straight nozzle with a constant pipe diameter, it is preferable that the opening 41 be disposed in an inner wall, set back from the outlet 31 of the blowing main hole 3 by a distance of 0.5 to 2.5 times the pipe diameter.

As for the shape of the opening 41 of the control gas supply passage 4 used in the present invention, for example, a round hole, an elliptical hole, or a polygonal hole that have a circular shape, an elliptical shape, and a polygonal shape, respectively, when the inner wall surface of the blowing main hole 3 is developed into a plane, or a circumferential slit or a partial slit can be suitably used. It is preferable that the openings 41 of the control gas supply passage 4 be provided at substantially regular intervals in a circumferential direction or have a slit shape. It is preferable that the total length of the openings 41 of the control gas supply passage 4 account for not less than 25% of the length of the inner wall surface of the blowing main hole 3 in the circumferential direction. "Substantially regular intervals in a circumferential direction" means that a distance S between center positions of each pair of adjacent openings 41 in the circumferential direction is within ±20% of an average value $S_{AVE}$ of the distance between the center positions of all pairs of adjacent openings 41 in the circumferential direction. When the total length that the openings 41 account for is less than 25%, the flow contracting effect on the oxygen-containing gas as the main flow may become so small that the flow velocity increasing effect on the jet gas may become insufficient.

Figure 2:
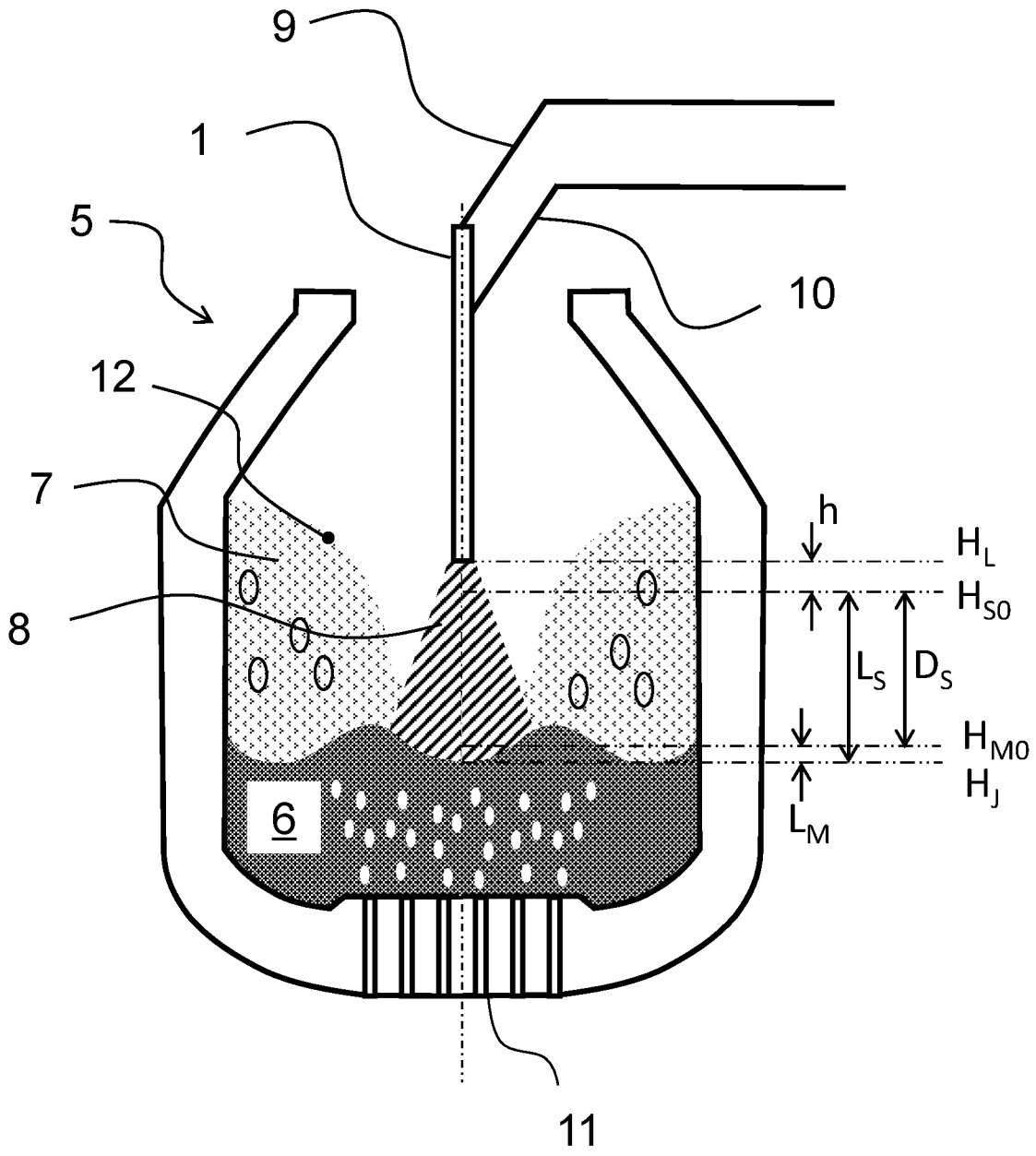
FIG. 2 is a sectional view of a device conceptually showing the molten iron dephosphorization method according to the embodiment of the present invention.

FIG. 2 is a sectional view of a converter showing a concept of implementing the molten iron dephosphorization method according to the present invention using the top-blowing lance 1. Molten iron 6 and slag 7 are charged in a converter vessel 5, and during blowing, an oxygen-containing gas is blown as a top-blown jet flow 8 from the top-blowing lance 1, while a gas for agitating is blown in through a bottom-blowing tuyere 11. The top-blowing lance 1 is provided with a main gas pipe 9 for supplying the main gas to the blowing main hole 3 and a control gas pipe 10 for supplying the control gas from the openings 41 inside the blowing main hole 3 through the control gas supply passage 4. During blowing, the slag 7 is foaming.

In the present invention, the height of foaming of the slag 7, i.e., the thickness of the slag is determined, and without the distance from a top surface of the molten iron to the leading end of the top-blowing lance 1 (lance height) being changed, the flow rate or the supply pressure of the control gas is controlled so as to bring the jet flow velocity of the top-blown jet flow 8 into an appropriate range. As a result, the top-blown jet flow 8 penetrates through the slag layer and comes into contact with the molten iron, which allows for efficient dephosphorization of the molten iron.

Here, to measure a height $H_{S0}$ of the foaming slag 7, a microwave level meter can be used. A height $H_{M0}$ of the molten iron 6 can be measured by a sublance. As a slag thickness $D_S$, a value obtained by subtracting the measured height $H_{M0}$ of the molten iron from the measured height $H_{S0}$ of the foaming slag is used. During blowing, the slag thickness $D_S$ changes dynamically as a dephosphorizing agent is added. A method of measuring a height $H_S$ of a top surface of the slag, or a method of estimating the slag thickness $D_S$ from a material balance and the bulk density of the slag that is obtained in advance can be used as needed.

In the first embodiment of the present invention, an arbitrary position on the top surface of the slag present on the molten iron during blowing is continuously or intermittently measured by, for example, a microwave level meter (a top-surface position measurement step). Then, the position of the top surface of the molten iron is measured using a sublance probe, and a surface shape having the depth of a depression in the top surface of the slag made by the oxygen-containing gas jetted from the top-blowing lance, to be described later, is obtained by numerical calculation or experiment. Thereafter, a difference from a position of the top surface of the slag obtained by averaging using the position of the top surface of the slag that has been actually measured earlier is calculated as the slag thickness (slag top-surface difference calculation step). Using the obtained slag thickness, without the height of the top-blowing lance being changed, the pressure or the flow rate of the control gas inside the blowing main hole is controlled so as to bring the jetting conditions of the oxygen-containing gas into an appropriate range and thus achieve the ideal surface shape (jetting condition adjustment step).

A depth $L_S$ of the surface depression during blowing can be calculated by, for example, combining the following Formula (2) with Formula (3). The surface depression is formed as the slag and the molten iron are pushed aside by the top-blown jet flow 8. This depression is formed as a depression in the slag until the top-blown jet flow 8 penetrates through the slag 7. After the top-blown jet flow 8 penetrates through the slag 7, this depression is formed as a depression in the molten iron.

$$L_S = L_h \cdot \exp(-0.78\ h/L_h) \quad (2)$$

$$L_h = 63 \times (\rho_S/\rho_M)^{-1/3} \times (F_{O2}/n/d_t)^{2/3} \quad (3)$$

Here, $L_S$: the depth of the depression made by the oxygen jet flow, which is a vertical distance from the top surface of the slag before the start of refining to a bottom of the surface depression (m);

h: the vertical distance from the leading end of the lance to the top surface of the slag before the start of refining (m);

$L_h$: the depth of the surface depression when h=0 (m);

$\rho_S$: the bulk density of the foaming slag (e.g., 200 kg/m$^3$);

$\rho_M$: the density of molten iron (molten pig iron) (e.g., 6900 kg/m$^3$);

$F_{O2}$: the total flow rate of the top-blown oxygen (the sum of the main gas flow rate and the control gas flow rate) (Nm$^3$/h);

n: the number of the nozzle holes of the top-blowing lance 1 (–); and $d_t$: the diameter of the nozzle throat (blowing main hole throat part 32) of the top-blowing lance 1 (m).

If the surface depression depth $L_S$ in Formula (2) is a value of not less than the slag thickness $D_S$, the top-blown jet flow 8 can be determined to have penetrated through the slag 7 and reached the molten iron 6.

As for the calculation method of the surface depression depth $L_S$, there are various other methods, including the following Formula (4) that is reported in Japanese Patent Laid-Open No. 2015-101734, and a method suitable for the circumstances of use should be selected from these formulae and used.

$$Vd_t = 0.73(L_S + h)L_S^{1/2} \quad (4)$$

Here, V: a vertical component of a jet velocity at the nozzle leading end (m/s).

In this embodiment, to calculate the surface depression depth $L_S$ during blowing by the above Formula (2), for example, a measurement point 12 at an arbitrary position on the top surface of the slag is first measured by a microwave level meter or the like. Then, from operation conditions such as the molten iron height $H_{M0}$ measured before the process, the slag height $H_{S0}$ measured during blowing, the height $H_L$ of the leading end of the top-blowing lance, the amount of slag obtained from the material balance, the composition and temperature of the slag, and the bulk density of the slag estimated from these composition, temperature, and amount of slag, the depth $L_S$ of the depression in the top surface of the slag made by the oxygen-containing gas jetted out from the top-blowing lance is calculated in addition to the calculation of the slag thickness $D_S$. As a result of the calculation, when the depth $L_S$ of the depression in the top surface of the slag exceeds 110% of the slag thickness $D_S$, the ratio of the pressures or the flow rates between the main gas that is the oxygen-containing gas and the control gas jetted from the top-blowing lance is adjusted such that the depth $L_S$ of the depression in the top surface of the slag calculated by the above Formulae (2) and (3) is not less than the value at which the oxygen-containing gas penetrates through the slag layer and reaches the molten iron, and that the depth $L_M$ of the depression in the molten iron made by the oxygen-containing gas having penetrated through the slag does not exceed 10% of the thickness of the slag. Here, the diameter $d_t$ of the nozzle throat of the top-blowing lance 1 in the above Formula (3) is an apparent circle-equivalent diameter of the blowing main hole throat part 32 that is restricted by the control gas. When $L_S > D_S$, $L_M$ is calculated by $L_S - D_S$.

In a second embodiment of the present invention, first, with the position of the top surface of the molten iron and the position of the top surface of the slag having been measured in advance by the above-described method or the like, an initial slag thickness is calculated (slag thickness calculation step). Then, changes in the surface level during blowing are measured using a microwave level meter or the like. At the same time, the generation amount of iron oxide that is calculated from the material balance during blowing, for example, the amount of dephosphorizing flux blown in and an analyzed value of exhaust gas, which are operation factors, is obtained, and the apparent bulk specific gravity of the slag is calculated. These are used as a backup in case the slag level is difficult to detect by a microwave level meter due to the generation of dust or the like (slag thickness change calculation step). Using the obtained initial slag thickness and the dynamic changes in the slag thickness, as in the first embodiment, adjustment is made such that the vertical component V of the jet velocity at the nozzle leading end of the oxygen-containing gas jetted from the top-blowing lance is not less than the value at which the oxygen-containing gas penetrates through the slag layer and reaches the molten iron, and that the depth $L_M$ of the depression in the molten iron made by the oxygen-containing gas having penetrated through the slag does not exceed 10% of the thickness of the slag (jetting condition adjustment step).

In the present invention, it is desirable that the oxygen-containing gas jetted from the top-blowing lance penetrates through the slag on the molten iron and reaches the top surface of the molten iron. This is because, as the top-blown oxygen jet flow penetrates through the slag and comes into contact with the molten iron, iron oxide (FeO) is generated in the area of contact of the jet, i.e., at the slag-metal interface, which promotes the dephosphorization reaction of Reaction Formula (1). As described above, in the case of dephosphorization in a top and bottom blown converter, if blowing is performed under conditions where the jet flow of oxygen-containing gas does not penetrate through the slag, oxygen fails to reach the slag-metal interface, while only iron oxide (FeO) that does not contribute to the dephosphorization reaction of the molten iron accumulates excessively in the slag, which not only reduces the dephosphorization efficiency but can also lead to slopping. Conversely, when the force of the top-blown oxygen jet flow is increased to more than required to penetrate through the slag, oxygen absorbed from the surface of the molten iron forms iron oxide (FeO). As the surface of the molten iron is agitated by the top-blown oxygen jet flow, this iron oxide is consumed by a decarburization reaction, which may reduce the efficiency of dephosphorizing oxygen. It is therefore desirable that the depth $L_S$ of the surface depression made by the top-blown oxygen jet flow be set to be just deep enough to penetrate through the slag. It is preferable that the depth $L_M$ of the depression in the molten iron made by the oxygen-containing gas having penetrated through the slag be less than 10% of the slag thickness.

The present invention has found an approach of controlling the nozzle shape factor $d_t$ among the elements of the above Formulae (2) and (3), without changing h relating to the height of the lance and the total oxygen flow rate $F_{O2}$. For example, using the top-blowing lance 1 of the shape shown in FIG. 1 according to one embodiment of the present invention, the above-described fluid device is formed by blowing in the control gas through the openings 41 provided at the throat part 32 of the blowing main hole 3. In this way, the present invention realizes dynamically changing the apparent shape of the throat part 32 of the blowing main hole 3. It has been experimentally proven that the relation between the ratio between a main gas supply pressure $P_m$ and a control gas supply pressure $P_a$ and the apparent circle-equivalent diameter $d_t$ of the nozzle throat is expressed by the following Formula (5):

$$d_t = d_{t0}(-0.09(P_a/P_m)+1) \quad (5)$$

Here, $d_{t0}$: the diameter of the blowing main hole at the position of the openings (mm);

$P_a$: the control gas supply pressure (gauge pressure); and $P_m$: the main gas supply pressure (gauge pressure).

The operation factor for actually controlling the pressure is the flow rate. Formula (5) can be organized with respect to the flow rate into the following Formula (5'):

$$d_t = d_{t0}(-0.09(A_{m0} \cdot Q_a)/(A_a Q_m)+1) \quad (5')$$

Here, $Q_a$: the control gas flow rate;

$Q_m$: the main gas flow rate;

$A_{m0}$: the cross-sectional area of the blowing main hole at the position of the openings ($mm^2$); and $A_a$: the cross-sectional area of the opening for supplying the control gas ($mm^2$).

As can be seen from the above Formulae (5) and (5'), control by the pressure ratio and control by the flow rate ratio are equivalent. Whichever of control by the pressure ratio and control by the flow rate ratio may be used in implementing the present invention.

In this embodiment, a change in the apparent circle-equivalent diameter dt of the nozzle throat is achieved by manipulating the ratio between the control gas supply pressure and the main gas supply pressure: $P_a/P_m$ or the ratio between the control gas flow rate and the main gas flow rate: $Q_a/Q_m$. As a result, it is possible to control the surface depression depth $L_S$ while maintaining the same h relating to the height of the lance, without changing the total oxygen flow rate $F_{O2}$. In other words, it is possible to allow the top-blown oxygen jet flow 8 to penetrate through the slag 7 by controlling the surface depression depth $L_S$ without reducing the area of the hot spot.

EXAMPLES

Example 1

As one example of the first embodiment in which dephosphorization is efficiently performed by the molten iron dephosphorization method of the present invention, a converter dephosphorization test involving blowing oxygen on molten pig iron using a top-blowing lance and thereby removing phosphorus in the molten pig iron was conducted using an actual top and bottom blown converter. The amount of molten pig iron was 283.8 tons, and the amount of scrap was 36.2 tons. The flow rate of a bottom-blown gas was 2400 $Nm^3/h$. The number of blowing main holes in the top-blowing lance was five. The outlet diameter was 0.071 m, and the throat diameter was 0.071 m. The shape of the opening was a circumferential slit shape with an opening width of 5.4 mm. The P concentration before the process was 0.125 mass %. The level of the position of the top surface of the slag at a position of ⅔ of the radius from the center was measured from a furnace opening using a microwave level meter. The height $H_{M0}$ of the molten iron before the start of blowing was measured by a sublance in advance. During blowing, a dephosphorizing flux was blown in at a rate of 10 kg/t relative to the molten pig iron. This is equivalent to increasing the total amount of slag by 10%.

The initial slag thickness $D_S$ obtained from the molten iron height $H_{M0}$ measured before the process and the slag height $H_{S0}$ measured by the microwave level meter was 3.40 m.

Dephosphorization blowing was started with the lance height and the blowing amount of oxygen adjusted based on Formulae (2) and (3) such that the surface depression depth $L_S$ became 3.45 m. Here, the ratio between the surface depression depth $L_S$ and the slag thickness $D_S$ was $L_S/D_S \times 100 = 101.5\%$, which is a condition where the top-blown jet flow is in contact with the molten iron.

During dephosphorization blowing, the level of the top surface of the slag was continuously measured using the microwave level meter, and an average over 10 seconds was used as a representative value of the slag surface level. During blowing, as a dephosphorizing flux was blown in, the amount of slag increased and the slag surface level rose.

To allow the top-blown jet flow to penetrate through the slag, the pressure ratio of the control gas was increased from 0.00 to 0.50 in accordance with Formula (5). As a result, the distance from the molten iron surface to the slag surface became equivalent to the ratio $L_S/D_S$ of the surface depression depth $L_S$ to the thickness $D_S$ of the slag layer, which was 101.5%.

When blowing was performed with the control gas ratio adjusted so as to maintain $L_S/D_S \times 100 = 101.5\%$ from the initial stage to the end of blowing as the method of the present invention, an amount of phosphorus removed $\Delta P$, which is the difference between the P concentration [mass %] in the initial molten iron and the P concentration [mass %] in the molten iron after completion of blowing, was 0.115 mass %.

On the other hand, when blowing was performed under such conditions that the top-blown jet flow did not reach the molten iron as the amount of slag increased, the amount of phosphorus removed $\Delta P$ was merely 0.068 mass % despite the same total blowing amount of oxygen.

Example 2

As one example of the second embodiment in which dephosphorization is efficiently performed by the molten iron dephosphorization method of the present invention, a converter dephosphorization test involving blowing oxygen on molten pig iron using a top-blowing lance and thereby removing phosphorus in the molten pig iron was conducted using an actual top and bottom blown converter. The amount of molten pig iron was 283.8 tons, and the amount of scrap was 36.2 tons. The flow rate of a bottom-blown gas was 2400 $Nm^3/h$. The number of blowing main holes in the top-blowing lance was five. The outlet diameter was 0.071 m, and the throat diameter was 0.071 m. The shape of the opening was a circumferential slit shape with an opening width of 5.4 mm. The P concentration before the process was 0.120 to 0.125 mass %.

Table 1 shows a result of performing an operation in the actual dephosphorization furnace. During the operation, the surface depression depth $L_S$ was calculated by Formula (2) while the ratio between the control gas supply pressure and the main gas supply pressure was controlled, and meanwhile, the dynamic slag height $D_S$ was calculated from operation conditions, for example, the initial amount of slag, the amount of dephosphorizing flux blown in, and the bulk density of the slag obtained from the slag composition and the slag temperature, and whether the top-blown jet flow penetrated through the slag was observed. The values of the surface depression depth $L_S$ and the slag height $D_S$ shown in Table 1 are those at the end of blowing.

The amount of phosphorus removed ΔP [mass %] in Table 1 was the same as in Example 1.

TABLE 1

| Process No. | Lance height change | Control gas pressure ratio $P_a/P_m$[—] | Surface depression depth $L_S$[m] | Slag thickness $D_S$ [m] | Ls/Ds [%] | Penetration through slag | ΔP [mass %] | Evaluation | Remarks |
|---|---|---|---|---|---|---|---|---|---|
| 1 | No change | 1.00 | 3.65 | 3.50 | 104.3 | Penetrated | 0.108 | Excellent | Inventive Example |
| 2 | No change | 1.30 | 3.85 | 3.50 | 110.0 | Penetrated | 0.093 | Good | Inventive Example |
| 3 | No change | 0.50 | 3.51 | 3.50 | 100.3 | Penetrated | 0.115 | Excellent | Inventive Example |
| 4 | No change | 0.50 | 3.47 | 3.42 | 101.5 | Penetrated | 0.118 | Excellent | Inventive Example |
| 5 | No change | 1.30 | 3.80 | 3.42 | 111.1 | Penetrated | 0.085 | Fair | Inventive Example |
| 6 | Reduced | 0.00 | 3.60 | 3.50 | 102.9 | Penetrated | 0.098 | Reference | Reference Example |
| 7 | No change | 0.00 | 3.30 | 3.50 | 94.3 | Not penetrated | 0.056 | Poor | Comparative Example |
| 8 | No change | 0.10 | 3.39 | 3.50 | 96.9 | Not penetrated | 0.068 | Poor | Comparative Example |

In Table 1, in all of Processes No. 1 to 5, blowing was performed with the control gas pressure adjusted such that the surface depression depth $L_S$ calculated by Formula (2) became larger than the slag thickness $D_S$ calculated from an actual measurement. On the other hand, in Processes No. 6 to 8, the control gas was not supplied. In Process No. 6, the lance height was reduced so as to make the surface depression depth $L_S$ and the slag thickness $D_S$ similar to those in Process No. 1. In each of Processes No. 7 and 8, blowing was performed under such conditions that the surface depression depth $L_S$ calculated by Formula (2) became smaller than the slag thickness $D_S$ calculated from an actual measurement.

In Processes No. 1 to 5 in which the top-blown oxygen jet flow was controlled so as to penetrate through the slag, the amounts of phosphorus removed ΔP are large compared with those in Processes No. 7 and 8 in which the top-blown oxygen jet flow was controlled so as not to penetrate through the slag. This proves that penetration of the top-blown oxygen jet flow through the slag is important in promoting the dephosphorization reaction in a top and bottom blown converter.

When Processes No. 1 and 6 that are equivalent in the surface depression depth $L_S$ relative to the slag thickness $D_S$ are compared, the amount of phosphorus removed ΔP is larger in Process No. 1. This seems to be because the control gas was supplied into the blowing main hole and the surface depression depth $L_S$ was controlled while the area of the hot spot was maintained, without the lance height being reduced. Further, in No. 1, 3, and 4 that have the condition that the surface depression depth $L_S$ relative to the slag thickness $D_S$ is less than 10% of the slag thickness $D_S$, i.e., the molten iron depression depth $L_M$ is less than 10% of the slag thickness $D_S$, the amounts of phosphorus removed are excellent as compared with that in Process No. 6 as a reference. On the other hand, in Processes No. 2 and 5 in which the molten iron depression depth $L_M$ is not less than 10% of the slag thickness, the amounts of phosphorus removed are equivalent to or lower than that in Process No. 6. This result indicates that an excessively deep surface depression could diminish the dephosphorization reaction promoting effect.

Example 3

Table 2 shows a result of performing an operation using the same device as in Example 2, with a change made to the flow rate ratio $Q_a/Q_m$ between the control gas and the main gas supplied to the top-blowing lance. The amount of molten pig iron was 283.8 tons, and the amount of scrap was 36.2 tons. The flow rate of a bottom-blown gas was 2400 $Nm^3/h$. The number of blowing main holes in the top-blowing lance was five. The outlet diameter was 0.071 m, and the throat diameter was 0.071 m. The shape of the opening was a circumferential slit shape with an opening width of 5.4 mm. The P concentration before the process was 0.120 to 0.125 mass %. Table 2 shows a result of performing an operation in the actual dephosphorization furnace. During the operation, the surface depression depth $L_S$ was calculated by Formulae (2) and (5') while the ratio between the control gas supply flow rate and the main gas supply flow rate was controlled, and meanwhile, the dynamic slag height $D_S$ was calculated from operation conditions, for example, the initial amount of slag, the amount of dephosphorizing flux blown in, and the bulk density of the slag obtained from the slag composition and the slag temperature, and whether or not the top-blown jet flow penetrated through the slag was observed. The values of the surface depression depth $L_S$ and the slag height $D_S$ shown in Table 2 are those at the end of blowing.

TABLE 2

| Process No. | Lance height change | Control gas flow rate ratio $Q_a/Q_m$[—] | Surface depression depth $L_S$[m] | Slag thickness $D_S$ [m] | $L_S/D_S$ [%] | Penetration through slag | ΔP [mass %] | Evaluation | Remarks |
|---|---|---|---|---|---|---|---|---|---|
| 9 | No change | 0.05 | 3.47 | 3.40 | 102.1 | Penetrated | 0.120 | Excellent | Inventive Example |
| 10 | No change | 0.10 | 3.66 | 3.50 | 104.5 | Penetrated | 0.105 | Excellent | Inventive Example |
| 11 | No change | 0.15 | 3.71 | 3.50 | 106.0 | Penetrated | 0.102 | Excellent | Inventive Example |
| 12 | No change | 0.01 | 3.41 | 3.50 | 97.4 | Not penetrated | 0.072 | Poor | Comparative Example |

In Table 2, in all of Processes No. 9 to 11, blowing was performed while the control gas flow rate was adjusted such that the surface depression depth $L_S$ calculated by Formula (2) became larger than the slag thickness $D_S$ calculated from an actual measurement. On the other hand, in Process No. 12, blowing was performed with the control gas supply amount reduced such that the surface depression depth $L_S$ became not larger than the slag thickness $D_S$.

In Processes No. 9 to No. 11 in which the top-blown oxygen jet flow was controlled so as to penetrate through the slag, the amounts of phosphorus removed ΔP are large compared with that in Process No. 12 in which the top-blown oxygen jet flow was controlled so as not to penetrate through the slag. This is the same trend as in Example 2.

INDUSTRIAL APPLICABILITY

The present invention is not limited to the scope of the above-described Examples but can be changed as appropriate within the scope of the technical idea of the invention. The molten iron is not limited to molten pig iron, and the invention is also applicable to molten iron alloys, such as molten manganese iron and molten chrome iron.

REFERENCE SIGNS LIST

1 Top-blowing lance
2 Cooling water circulation passage
3 Blowing main hole
31 Blowing main hole outlet
32 Blowing main hole throat part
33 Blowing main hole inlet
34 Gas tank
4 Control gas supply passage
41 Opening
5 Converter vessel
6 Molten iron
7 Slag
8 Top-blown jet flow
9 Main gas pipe
10 Control gas pipe
11 Bottom-blowing tuyere
12 Slag top-surface position measurement point

The invention claimed is:

1. A molten iron dephosphorization method that uses a top and bottom blown converter charged with molten iron and slag, and that, to perform dephosphorization of the molten iron by blowing an oxygen-containing gas from a top-blowing lance, supplies the oxygen-containing gas as a main gas from an inlet of one or more blowing main holes that are disposed so as to extend through an outer shell of the top-blowing lance, and supplies a control gas from an opening disposed in an inner wall surface of the blowing main hole toward an axial center of the blowing main hole through a control gas supply passage, characterized in that the method comprises:

a slag top-surface position measurement step of, with a position of a top surface of the molten iron having been measured in advance, continuously or intermittently measuring an arbitrary position in a top surface of the slag present on the molten iron;

a slag top-surface difference calculation step of calculating a slag thickness that is a difference between the measured top-surface positions of the molten iron and the slag; and a jetting condition adjustment step of, using the obtained slag thickness, adjusting a range of a jetting condition of the oxygen-containing gas jetted from the top-blowing lance, wherein the oxygen-containing gas jetted from the top-blowing lance penetrates through the slag on the molten iron and reaches the top surface of the molten iron, a depth of a depression in the molten iron made by the oxygen-containing gas having penetrated through the slag is less than 10% of the thickness of the slag, and the slag is foaming during blowing of the oxygen-containing gas.

2. A molten iron dephosphorization method that uses a top and bottom blown converter charged with molten iron and slag, and that, to dephosphorize the molten iron by blowing an oxygen-containing gas from a top-blowing lance, supplies the oxygen-containing gas as a main gas from an inlet of one or more blowing main holes that are disposed so as to extend through an outer shell of the top-blowing lance, and supplies a control gas from an opening disposed in an inner wall surface of the blowing main hole toward an axial center of the blowing main hole through a control gas supply passage, characterized in that the method comprises:

an initial slag thickness calculation step of, with a position of a top surface of the molten iron and a position of a top surface of the slag having been measured in advance, calculating a slag thickness;

a slag thickness change calculation step of continuously measuring the position of the top surface of the slag during blowing and calculating changes in the slag thickness; and a jetting condition adjustment step of, using the obtained initial slag thickness and changes in the slag thickness, adjusting a range of a jetting condition of the oxygen-containing gas jetted from the top-blowing lance, wherein the oxygen-containing gas jetted from the top-blowing lance penetrates through the slag on the molten iron and reaches the top surface of the molten iron, a depth of a depression in the molten iron made by the oxygen-containing gas having penetrated through the slag is less than 10% of the thickness of the slag, and the slag is foaming during blowing of the oxygen-containing gas.

3. The molten iron dephosphorization method according to claim 1, wherein an adjustment of the jetting condition of the top-blowing lance is an adjustment of a ratio between a control gas supply pressure and a main gas supply pressure.

4. The molten iron dephosphorization method according to claim 1, wherein an adjustment of the jetting condition of the top-blowing lance is an adjustment of a ratio between a control gas flow rate and a main gas flow rate.

5. The molten iron dephosphorization method according to claim 2, wherein an adjustment of the jetting condition of the top-blowing lance is an adjustment of a ratio between a control gas supply pressure and a main gas supply pressure.

6. The molten iron dephosphorization method according to claim 2, wherein an adjustment of the jetting condition of the top-blowing lance is an adjustment of a ratio between a control gas flow rate and a main gas flow rate.

* * * * *